US008516816B2

(12) United States Patent
Pursifull et al.

(10) Patent No.: US 8,516,816 B2
(45) Date of Patent: Aug. 27, 2013

(54) AVOIDANCE OF COOLANT OVERHEATING IN EXHAUST-TO-COOLANT HEAT EXCHANGERS

(75) Inventors: Ross Dykstra Pursifull, Dearborn, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 393 days.

(21) Appl. No.: 12/792,662

(22) Filed: Jun. 2, 2010

(65) Prior Publication Data

US 2011/0296832 A1 Dec. 8, 2011

(51) Int. Cl.
*F02B 33/44* (2006.01)

(52) U.S. Cl.
USPC ..... 60/605.2; 60/599; 60/602; 60/605.1

(58) Field of Classification Search
USPC ..... 60/605.2, 599, 602, 605.1
See application file for complete search history.

(56) References Cited

U.S. PATENT DOCUMENTS 5,036,668 A * 8/1991 Hardy ..... 60/599
5,927,075 A 7/1999 Khair
6,367,256 B1 4/2002 McKee
6,820,599 B2 * 11/2004 Kurtz et al. ..... 123/568.21
2004/0194917 A1 10/2004 Usui
2005/0188965 A1 9/2005 Usui
2008/0190108 A1 8/2008 Eitel et al.

FOREIGN PATENT DOCUMENTS

JP 2001132553 5/2001
JP 2002147291 5/2002
JP 2005344591 12/2005

OTHER PUBLICATIONS

Barbe et al., System and Method for Diagnostic of Low Pressure Exhaust Gas Recirculation System and Adapting of Measurement Devices, US Patent Application Publication, Pub. No. US 2008/0022677 A1, Jan. 31, 2008.*

* cited by examiner

*Primary Examiner* — Ching Chang
(74) *Attorney, Agent, or Firm* — Julia Voutyras; Alleman Hall McCoy Russell & Tuttle LLP

(57) ABSTRACT

A method for operating an engine system comprises charging a cylinder of the engine system with exhaust from upstream of an exhaust turbine at a first rate. The method further comprises charging the cylinder with exhaust from downstream of the turbine at a second rate. The exhaust from downstream of the turbine is routed to the cylinder via a low-pressure exhaust-gas recirculation path. The method further comprises increasing the second rate relative to the first rate in response to a coolant-overheating condition.

19 Claims, 4 Drawing Sheets

AVOIDANCE OF COOLANT OVERHEATING IN EXHAUST-TO-COOLANT HEAT EXCHANGERS

TECHNICAL FIELD

This application relates to the field of motor-vehicle engineering, and more particularly, to engine cooling systems of motor vehicles.

BACKGROUND AND SUMMARY

A cooling system for a motor vehicle may include one or more heat exchangers that draw heat from an engine exhaust flow. An exhaust-gas recirculation (EGR) cooler is one such heat exchanger. Liquid coolant in the heat exchanger may circulate in a closed loop that includes a radiator. From the radiator, excess heat is discharged to the ambient air. In some configurations and scenarios, the heat from the exhaust flow may greatly increase the temperature and vapor pressure of the coolant. The conduits of the cooling system must therefore maintain the coolant at an elevated pressure to avoid boiling.

In addition, some measures may be taken to limit the maximum temperature of the coolant, and thereby limit the vapor pressure. Fully passive temperature-limiting approaches assume worst-case conditions—effectively reducing the effectiveness of the EGR cooler in order to avoid coolant overheating at extreme conditions. Alternatively, in U.S. Pat. No. 6,367,256, a portion of an exhaust flow is by-passed around an EGR cooler under conditions of low coolant flow and high EGR flow. To avoid coolant overheating, the heat-exchange process is dialed down. By providing a reduced rate of exhaust cooling, however, this approach may fail to enable the full range of benefits of cooled EGR.

The inventor herein has recognized these issues and has devised a series of approaches to address them. Therefore, one embodiment of this disclosure provides a method for operating an engine system having a cylinder, an exhaust turbine, and an intake-air compressor. In this method the cylinder is charged with exhaust from upstream of the turbine (internal or high-pressure EGR) at a first rate. The cylinder is charged with exhaust from downstream of the turbine (low-pressure EGR) at a second rate. The method further comprises increasing the second rate relative to the first rate in response to a coolant-overheating condition. In this manner, more of the exhaust heat is discharged directly to the ambient air during the coolant-overheating condition, without passing through the coolant. Such an approach may extend the benefits of cooled EGR over a larger portion of the engine map, while still providing the desired overall level of exhaust residuals.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted herein.

DETAILED DESCRIPTION

Figure 1:
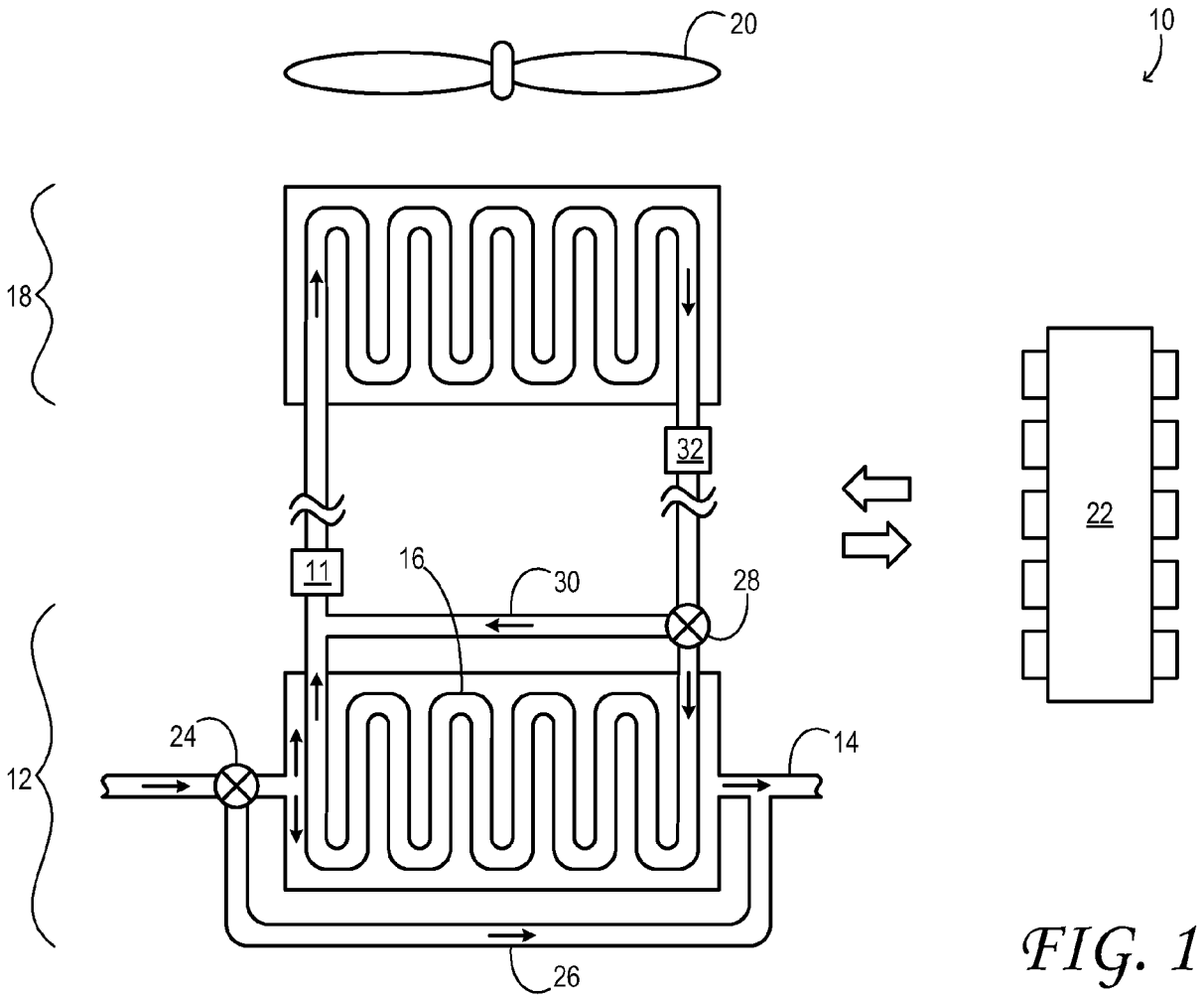
FIG. 1 schematically shows aspects of an example motor-vehicle cooling system in accordance with an embodiment of this disclosure.

The subject matter of this disclosure is now described by way of example and with reference to certain illustrated embodiments. Components, process steps, and other elements that may be substantially the same in one or more embodiments are identified coordinately and are described with minimal repetition. It will be noted, however, that elements identified coordinately may also differ to some degree. It will be further noted that the drawing figures included in this disclosure are schematic and generally not drawn to scale. Rather, the various drawing scales, aspect ratios, and numbers of components shown in the figures may be purposely distorted to make certain features or relationships easier to see.

FIG. 1 schematically shows aspects of an example cooling system 10 of a motor vehicle. The cooling system includes coolant pump 11. The coolant pump is configured to force a liquid engine coolant—water or a water-based antifreeze solution, for example—through conduits that link the various cooling-system components. The cooling system also includes heat exchanger 12, which is a gas-to-liquid heat exchanger.

Heat exchanger 12 includes a first conduit 14 for conducting a gas flow—an air or exhaust flow, for example. The heat exchanger also includes a second conduit 16 for conducting the liquid engine coolant. As shown in FIG. 1, the second conduit of the heat exchanger is a segment of a closed coolant loop. The closed coolant loop includes radiator 18 and other engine components. In one embodiment, the closed coolant loop may include a plurality of cylinder jackets of the engine system in which cooling system 10 is installed.

In heat exchanger 12, the first and second conduits are configured to enhance the rate of heat exchange between the gas flowing through first conduit 14 and the coolant flowing through second conduit 16. To this end, the heat exchanger may provide an extended (e.g., tortuous) shared interfacial area between the two conduits. Similarly, the coolant conduit of radiator 18 may be configured for enhanced heat exchange with the ambient air. In the embodiment shown in FIG. 1, fan 20 is arranged opposite the radiator and configured to increase convection of the ambient air around and through the radiator.

Under some conditions, cooling system 10 may be configured to controllably limit the rate of heat exchange in heat exchanger 12 and/or radiator 18. Such control may be provided via electronic control system 22 or any electronic control system of the vehicle in which cooling system 10 is installed. In the embodiment illustrated in FIG. 1, the heat exchanger includes a two-way by-pass valve 24, which controllably diverts a portion of the gas flow through gas-flow by-pass conduit 26. The heat exchanger also includes two-way by-pass valve 28, which controllably diverts a portion of the coolant flow through coolant-flow by-pass conduit 30. The two-way by-pass valves may be electronically controlled portioning valves, for example. In the illustrated embodiment, two-way by-pass valve 28 provides two flow positions: a first position where coolant from the radiator flows through second conduit 16 of heat exchanger 12, and a second position where coolant from the radiator flows through by-pass conduit 30. Two-way by-pass valve 24 also provides two flow positions: a first position where the gas flows through first conduit 14 of the heat exchanger, and a second position where the gas flows through gas-flow by-pass conduit 26.

The two-way by-pass valves may be actuated via electronic control system 22. The electronic control system effect a decrease in the rate of heat exchange by increasing the amount of gas or coolant flow that is diverted through the by-pass conduits, or vice versa. Likewise, coolant pump 11 and fan 20 may be operatively coupled to the electronic control system. The electronic control system may be configured to vary the speed of the coolant pump and the fan in order to provide the desired rate of heat exchange between the coolant and the ambient air. In one embodiment, the electronic control system may be configured to increase the fan speed (e.g., proportionally) as the speed of coolant pump 11 increases, and to decrease the fan speed as the speed of the coolant pump decreases.

In the embodiments contemplated herein, electronic control system 22 may be configured to vary any or all of the above rates of heat exchange in order to maintain the overall performance of cooling system 10 and of the engine system in which the cooling system is installed. In one embodiment, the electronic control system may be configured to vary any or all of the above rates to prevent the coolant from overheating. Accordingly, cooling system 10 includes sensor 32 operatively coupled to the electronic control system. The electronic control system is configured to interrogate the sensor to determine whether a coolant-overheating condition exists. In one embodiment, the sensor may be a temperature sensor responsive to the temperature of the coolant in the cooling system. In another embodiment, the sensor may be a pressure sensor responsive to the pressure of the coolant in the cooling system. In yet another embodiment, the sensor may be a dimensional sensor responsive to a dimension of an expandable cavity (e.g., conduit) of the cooling system that contains the coolant. In still other embodiments, the electronic control system may be configured to determine or estimate indirectly whether a coolant-overheating condition exists. In one embodiment, the electronic control system may be configured to model the heat balance in one or more components of the engine system in which the cooling system is installed. Suitable inputs for such modeling may include engine speed, engine torque, or manifold air pressure, as examples.

Naturally, it will be understood that FIG. 1 shows only a portion of one example cooling system, and that other, more complex cooling systems may be used instead. Although FIG. 1 shows only one heat exchanger in cooling system 10, a plurality of heat exchangers may be included—EGR coolers and charge-air coolers, for example. Arranged fluidically in series or in parallel, the plurality of coolers may each conduct the same, radiator-cooled engine coolant. In other embodiments, the cooling system may comprise a plurality of non-communicating coolant loops. An important principle of thermal management is that the various components of a thermally managed system should reach a steady-state operating temperature before excess heat is released to the ambient. Based on this principle, it is desirable to route heat from a high-temperature source—exhaust heat, for example—lastly to the ambient, firstly to other motor-vehicle components: intake air, cabin heat, engine oil, transmission fluid, cylinder/head water jackets, as examples.

Figure 2:
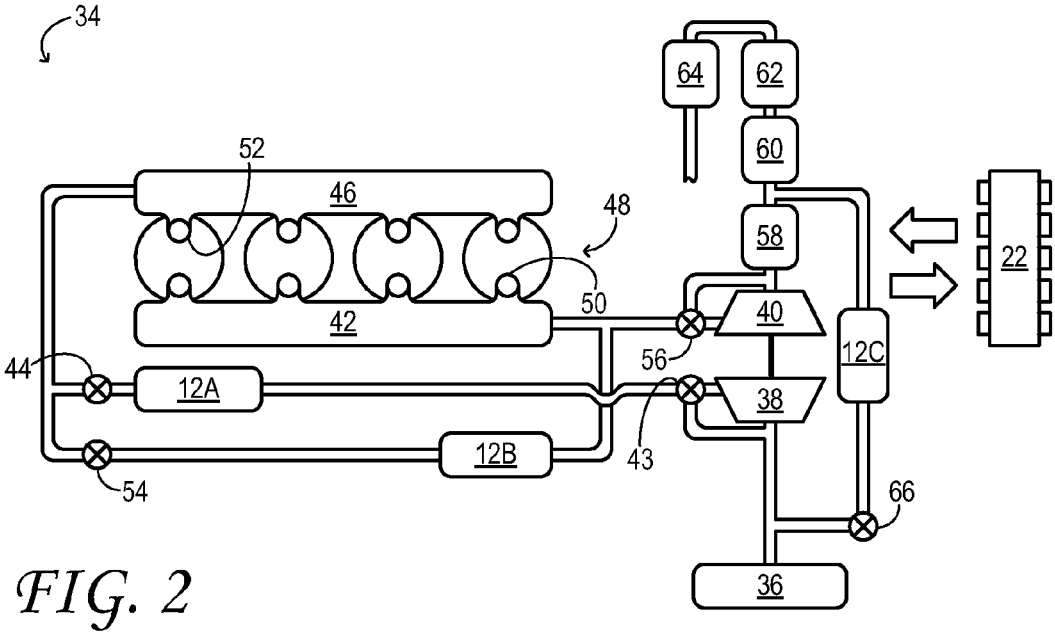
FIGS. 2 and 3 schematically show other aspects of example motor-vehicle engine systems in accordance with embodiments of this disclosure.

FIG. 2 schematically shows aspects of an example engine system 34 in one embodiment. In engine system 34, air cleaner 36 is coupled to the inlet of compressor 38. The air cleaner inducts fresh air from the ambient and provides filtered, fresh air to the compressor. The compressor may be any suitable intake-air compressor—a motor or drive-shaft driven supercharger compressor, for example. In the embodiment illustrated in FIG. 2, however, the compressor is a turbocharger compressor mechanically coupled to turbine 40, the turbine driven by expanding engine exhaust from exhaust manifold 42. By-pass valve 43 is coupled across the compressor from outlet to inlet, so that some or all of the compressed air charge from downstream of the compressor may be discharged to a locus upstream of the compressor. This action may be taken to avert or alleviate compressor surge, or for other reasons, as further described hereinafter. In one embodiment, the compressor and turbine may be coupled within a twin scroll turbocharger. In another embodiment, the compressor and turbine may be coupled within a variable geometry turbocharger (VGT), where turbine geometry is actively varied as a function of engine speed. In yet other embodiments, a by-pass or blow-off valve of the compressor may be configured to discharge the compressed air charge to another locus of engine system 34.

In engine system 34, the outlet of compressor 38 is coupled to charge-air cooler 12A. The charge-air cooler is a gas-to-liquid heat exchanger; it includes a first conduit for the compressed air charge and a second conduit for engine coolant. Accordingly, the second conduit of the charge-air cooler may be a segment of a closed coolant loop that includes engine cylinder jackets and a radiator. From the first conduit of charge-air cooler, the compressed air charge flows through throttle valve 44 to intake manifold 46.

In engine system 34, exhaust manifold 42 and intake manifold 46 are coupled, respectively, to a series of combustion chambers 48 through a series of exhaust valves 50 and intake valves 52. In one embodiment, each of the exhaust and intake valves may be electronically actuated. In another embodiment, each of the exhaust and intake valves may be cam actuated. Whether electronically actuated or cam actuated, the timing of exhaust and intake valve opening and closure may be adjusted as needed for desirable combustion and emissions-control performance. In particular, the valve timing may be adjusted so that combustion is initiated when a substantial amount of exhaust from a previous combustion is still present in one or more of the combustion chambers. Such adjusted valve timing may enable an 'internal EGR' mode useful for reducing peak combustion temperatures under selected operating conditions. In some embodiments, adjusted valve timing may be used in addition to the 'external EGR' modes described hereinafter.

FIG. 2 shows electronic control system 22. In embodiments where at least one intake or exhaust valve is configured to open and close according to an adjustable timing, the adjustable timing may be controlled via the electronic control system to regulate an amount of exhaust present in a combustion chamber at the time of ignition. To assess operating conditions in connection with various control functions of the engine system, the electronic control system may be operatively coupled to a plurality of sensors arranged throughout the engine system—flow sensors, temperature sensors, pedal-position sensors, pressure sensors, etc.

In combustion chambers 48 combustion may be initiated via spark ignition and/or compression ignition in any variant. Further, the combustion chambers may be supplied any of a variety of fuels: gasoline, alcohols, diesel, biodiesel, compressed natural gas, hydrogen, etc. Fuel may be supplied to the combustion chambers via direct injection, port injection, throttle-body injection, or any combination thereof.

In engine system 34, high-pressure (HP) EGR cooler 12B is coupled downstream of exhaust manifold 42 and upstream of turbine 40. The HP EGR cooler is a gas-to-liquid heat exchanger; it includes a first conduit for the high-pressure exhaust flow and a second conduit for engine coolant. Accordingly, the second conduit of the HP EGR cooler may be a segment of a closed coolant loop that includes engine cylinder jackets and a radiator. From the first conduit of the HP EGR cooler, HP exhaust flows through portioning valve 54 to intake manifold 46. Coupled downstream of the HP EGR cooler, the portioning valve controls the flow of recirculated exhaust through the external HP EGR path of the engine system.

Engine system 34 also includes waste gate 56, coupled across turbine 40 from inlet to outlet. Exhaust from exhaust manifold 42 flows to turbine 40 to drive the turbine, as noted above. When reduced turbine torque is desired, some exhaust may be directed instead through waste gate 56, by-passing the turbine. The combined flow from the turbine and the waste gate then flows through exhaust-aftertreatment devices 58, 60, and 62. The nature, number, and arrangement of the exhaust-aftertreatment devices may differ in the different embodiments of this disclosure. In general, the exhaust-aftertreatment devices may include at least one exhaust-aftertreatment catalyst configured to catalytically treat the exhaust flow, and thereby reduce an amount of one or more substances in the exhaust flow. For example, one exhaust-aftertreatment catalyst may be configured to trap NOX from the exhaust flow when the exhaust flow is lean, and to reduce the trapped NOX when the exhaust flow is rich. In other examples, an exhaust-aftertreatment catalyst may be configured to disproportionate NOX or to selectively reduce NOX with the aid of a reducing agent. In other examples, an exhaust-aftertreatment catalyst may be configured to oxidize residual hydrocarbons and/or carbon monoxide in the exhaust flow. Different exhaust-aftertreatment catalysts having any such functionality may be arranged in wash coats or elsewhere in the exhaust-aftertreatment devices, either separately or together. In some embodiments, the exhaust-aftertreatment devices may include a regenerable soot filter configured to trap and oxidize soot particles in the exhaust flow. Further, in one embodiment, exhaust-aftertreatment device 58 may comprise a light-off catalyst.

Continuing in FIG. 2, engine system 34 includes silencer 64 coupled downstream of exhaust-aftertreatment device 62. All or part of the treated exhaust from the exhaust aftertreatment devices may be released into the ambient via the silencer. Depending on operating conditions, however, some treated exhaust may be drawn instead through low pressure (LP) EGR cooler 12C. The LP EGR cooler is a gas-to-liquid heat exchanger; it includes a first conduit for the LP exhaust flow and a second conduit for engine coolant. Accordingly, the second conduit of the LP EGR cooler may be a segment of a closed coolant loop that includes engine cylinder jackets and a radiator. From the first conduit of the LP EGR cooler, LP exhaust flows through portioning valve 66 to the inlet of compressor 38. Coupled downstream of the LP EGR cooler, the portioning valve controls the flow of recirculated exhaust through the external LP EGR path of the engine system.

In some embodiments, by-pass valve 43, throttle valve 44, waste gate 56, and portioning valves 54 and 66 may be electronically controlled valves configured to close and open at the command of electronic control system 22. Further, one or more of these valves may be continuously adjustable. The electronic control system may be operatively coupled to each of the electronically controlled valves and configured to command their opening, closure, and/or adjustment as needed to enact any of the control functions described herein.

By appropriately controlling portioning valves 54 and 66, and by adjusting the exhaust and intake valve timing (vide supra), electronic control system 22 may enable engine system 34 to deliver intake air to combustion chambers 48 under varying operating conditions. These include conditions where EGR is omitted from the intake air or is provided internal to each combustion chamber (via adjusted valve timing, for example); conditions where EGR is drawn from a take-off point upstream of turbine 40 and delivered to a mixing point downstream of compressor 38 (external HP EGR); and conditions where EGR is drawn from a take-off point downstream of the turbine and delivered to a mixing point upstream of the compressor (external LP EGR).

It will be understood that no aspect of FIG. 2 is intended to be limiting. In particular, take-off and mixing points for external HP and LP EGR may differ in embodiments fully consistent with the present disclosure. For example, while FIG. 2 shows external LP EGR being drawn from downstream of exhaust-aftertreatment device 58, the external LP EGR may in other embodiments be drawn from downstream of exhaust-aftertreatment device 62, or upstream of exhaust-aftertreatment device 58. Further, some configurations fully consistent with this disclosure may lack the external HP EGR path and may achieve suitable combustion performance using a combination of internal EGR and external LP EGR.

Figure 3:
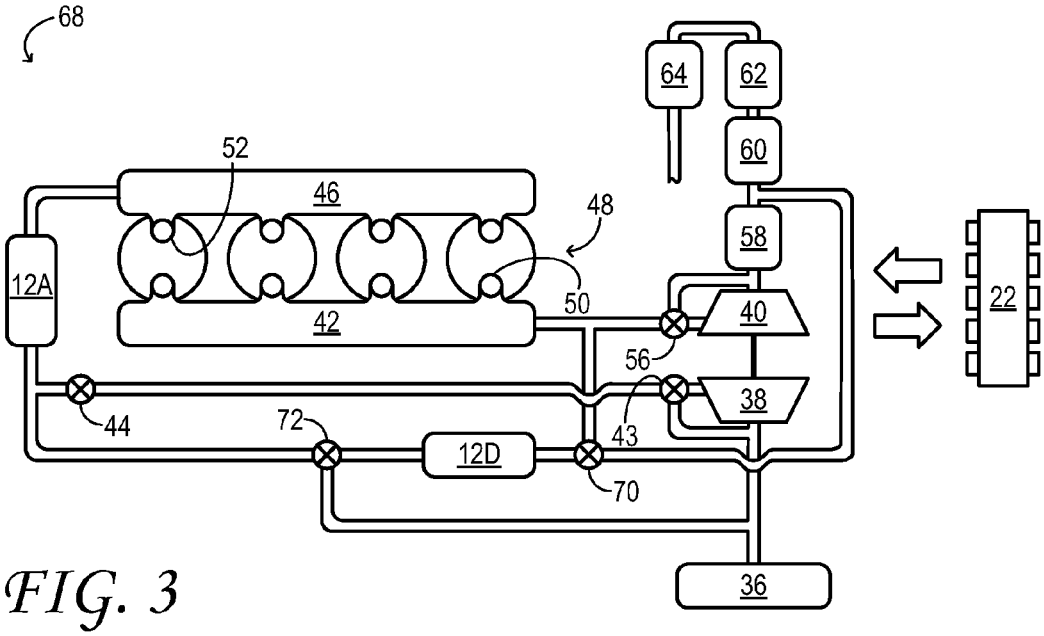

FIG. 3 schematically shows aspects of another example engine system 68 in one embodiment. Like engine system 34, engine system 68 includes an external HP EGR path and an external LP EGR path. In engine system 68, however some components of the HP and LP EGR paths are shared in common.

Engine system 68 includes high-temperature (HT) EGR cooler 12D. The HT EGR cooler is a gas-to-liquid heat exchanger; it includes a first conduit for the recirculated exhaust flow and a second conduit for engine coolant. Accordingly, the second conduit of the HT EGR cooler may be a segment of a closed coolant loop that includes engine cylinder jackets and a radiator. EGR selecting valve 70 is coupled upstream of the HT EGR cooler. The EGR selecting valve is a two-way valve; its position determines whether exhaust from upstream or downstream of turbine 40 is admitted to the HT EGR cooler. EGR directing valve 72 is coupled downstream of the HT EGR cooler. The EGR directing valve is a two-way valve; its position determines whether the recirculated exhaust is directed to an LP mixing point upstream of compressor 38 or to an HP mixing point downstream of the compressor.

The configurations described above enable various methods for operating an engine system of a motor vehicle. Accordingly, some such methods are now described, by way of example, with continued reference to above configurations. It will be understood, however, that the methods here described, and others fully within the scope of this disclosure, may be enabled via other configurations as well. The methods presented herein include various measuring and/or sensing events enacted via one or more sensors disposed in the engine system. The methods also include various computation, comparison, and decision-making events, which may be enacted in an electronic control system operatively coupled to the sensors. The methods further include various hardware-actuating events, which the electronic control system may command selectively, in response to the decision-making events.

Figure 4:
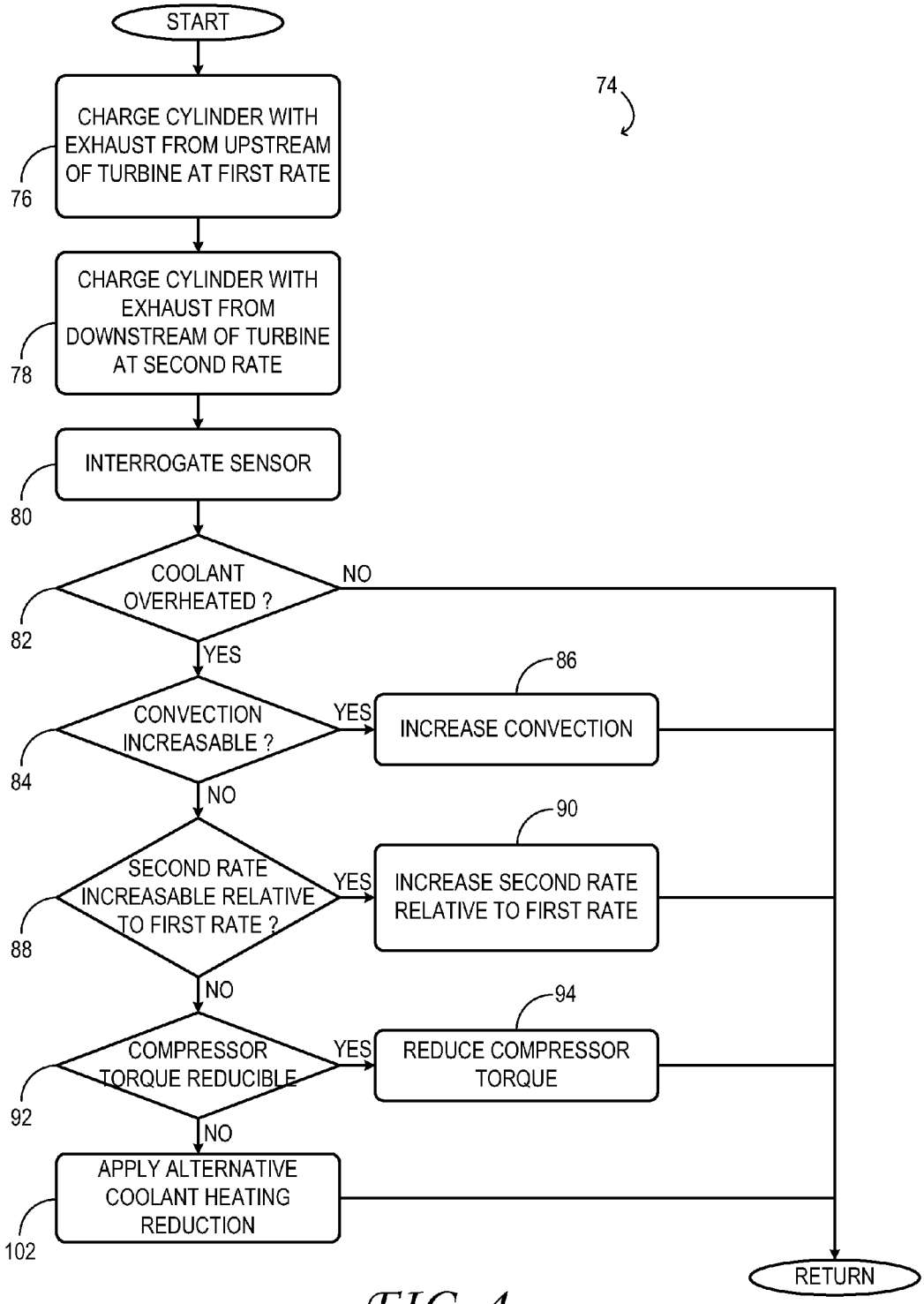
FIG. 4 illustrates an example method for operating a motor-vehicle engine system in accordance with an embodiment of this disclosure.

FIG. 4 illustrates an example method 74 for operating an engine system of a motor vehicle. The method may be entered upon any time the engine system is operating, and it may be executed repeatedly. Naturally, each execution of the method may change the entry conditions for a subsequent execution and thereby invoke a complex decision-making logic. Such logic is fully contemplated in this disclosure.

At 76 a cylinder of the engine system is charged with exhaust from upstream of an exhaust turbine at a first rate. In one embodiment, the cylinder may be charged at the first rate via an external HP EGR path of the engine system. In another embodiment, the cylinder may be charged at the first rate through any suitable internal EGR strategy, as noted hereinabove. Accordingly, charging the cylinder with exhaust from upstream of the turbine may comprise controlling a valve timing of the cylinder to retain exhaust from a previous combustion event in the same cylinder during a subsequent combustion event. In yet another embodiment, external HP EGR may be used in addition to internal EGR, either concurrently or sequentially, depending on conditions.

At 78 the cylinder is charged with exhaust from downstream of the exhaust turbine at a second rate. This exhaust may be delivered to the cylinder via an external LP EGR path of the engine system. It will be understood that the foregoing method steps place no constraints on when the exhaust from upstream or downstream of the turbine is provided to the cylinder. In one embodiment, the pre-turbine or post-turbine exhaust may be used exclusively, depending on conditions. In another embodiment, any suitable admixture of pre-turbine and post-turbine exhaust may be used, concurrently or sequentially, depending on conditions.

At 80 a sensor of the cooling system is interrogated. The sensor may be directly or indirectly responsive to a temperature or pressure in the cooling system, or to a dimension of an expandable cavity of the cooling system, as noted hereinabove. Based on the interrogation of the sensor, it is determined at 82 whether or not the coolant overheated. If the coolant is overheated, then the method advances to 84. If the coolant is not overheated, then the method returns.

At 84 it is determined whether a rate of convection in the cooling system—i.e., the coolant flow rate or the velocity of air impelled by a radiator fan—can be further increased. If the rate of convection can be further increased, then the method advances to 86, where the rate of convection is increased. In one embodiment, the radiator fan speed may be increased; in another embodiment, the flow rate of the coolant through a radiator or other heat exchanger may be increased. However, if the rate of convection cannot be further increased, then the method advances to 88.

At 88 it is determined whether the second rate (the rate at which post-turbine exhaust is delivered to the cylinder) can be further increased relative to the first rate (the rate at which pre-turbine exhaust is delivered to the cylinder). If the second rate can be further increased relative to the first rate, then the method advances to 90, where the second rate is increased relative to the first rate; otherwise, the method advances to 92. As described hereinabove, increasing the second rate relative to the first rate may comprise increasing a rate of external LP EGR relative to a rate of internal EGR or external HP EGR.

Figure 5:
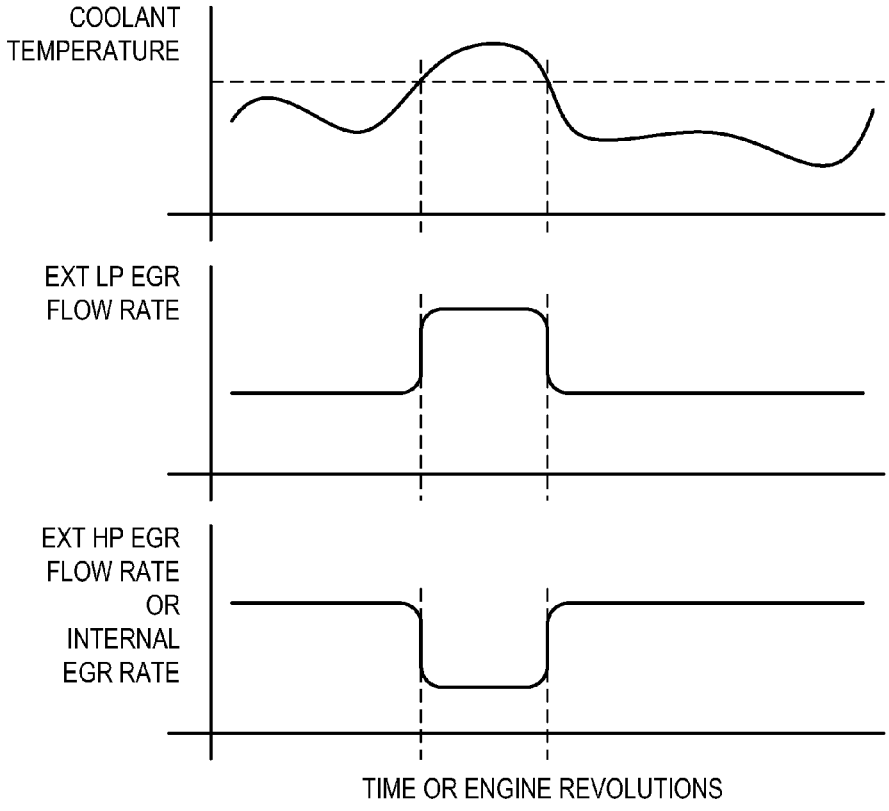
FIG. 5 shows a set of graphs that illustrate how changes in coolant temperature may trigger a change in the relative flow rates of external LP EGR and external HP or internal EGR, in accordance with an embodiment of this disclosure.

The graphs of FIG. 5 illustrate, in one non-limiting example, how changes in coolant temperature may trigger a change in the relative flow rates of external LP EGR and external HP or internal EGR. As shown in these graphs, when the coolant temperature rises above a predetermined threshold, the flow rate of external LP EGR is increased. The flow rate may be increased, for example, by increasing an opening of a valve in an external LP EGR path of the engine system, by decreasing an opening of a pre-compressor intake throttle, or in any other suitable manner. At the same time as the flow rate of external LP EGR is increased, the flow rate of external HP EGR and/or the rate of internal EGR is decreased. In engine configurations having an external HP EGR path, the flow rate may be decreased by decreasing an opening of a valve in the external HP EGR path, by increasing an opening of an exhaust throttle, or in any other suitable manner. In engine systems configured for internal EGR, the flow rate may be decreased by advancing an exhaust-valve opening timing.

Returning now to method 74 of FIG. 4, at 92 it is determined whether the compressor torque is further reducible. If compressor torque is further reducible, then the method advances to 94, where the compressor torque is reduced.

Figure 6:
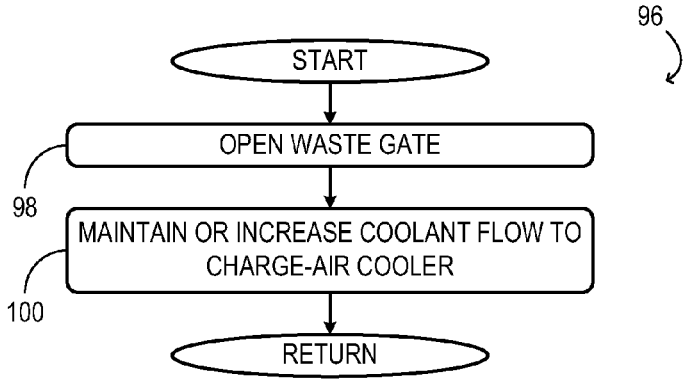
FIG. 6 illustrates an example method for reducing compressor torque in accordance with an embodiment of this disclosure.

FIG. 6 illustrates an example method 96 for reducing the compressor torque in one embodiment. At 98 of method 96 a waste gate of a turbine of the engine system is opened. This action will allow some or all of the exhaust flow to be bypassed around the turbine in response to the coolant-overheating condition. At 100 the coolant flow through a charge-air cooler of the engine system is maintained or increased. While the compressor torque is being reduced and after the compressor torque has been reduced, therefore, the rate of coolant flow to the charge-air cooler of the engine system may be maintained or increased. During these conditions, the cylinders will combust less fuel and will produce less heat. In addition, the charge-air cooler will draw heat from the coolant and expel the heat into the intake air, thereby decreasing the temperature of the coolant. From 100, method 96 returns.

It will be understood that FIG. 6 illustrates only one of several contemplated methods for reducing compressor torque and thereby decreasing the flow of heat into the charge-air cooler. In another embodiment, a by-pass or blow-off valve of the compressor may be opened in order to reduce the compressor torque. In yet another embodiment, one or more vanes of a VGT may be adjusted to extract energy from the exhaust, resulting in less torque to the compressor. Still other embodiments may provide different approaches to reducing compressor torque.

Returning again to method 74 of FIG. 4, if the compressor torque is not further reducible, then the method advances to 102, where alternative coolant-heating reduction is applied. Such alternative coolant-heating reduction may include, in one embodiment, disabling a fuel injector of the cylinder and drawing air through the cylinder; it may include virtually any mode of decreasing engine output. In another embodiment, the alternative coolant-heating reduction may include reducing the portion of external HP or external LP EGR routed through an EGR cooler—by increasing the amount diverted through a by-pass conduit, for example. In another embodiment, the alternative coolant-heating reduction may include decreasing the rate of flow of the coolant though the EGR cooler. These actions will reduce the rate at which exhaust heat is absorbed by the coolant and may relieve the coolant-overheating condition even if the foregoing actions are not successful. From 86, 90, 94, or 102, the method returns.

From the foregoing description, it will be evident that repeated execution of method 74 effectively prioritizes the various actions that may be taken to alleviate coolant overheating. The first measures taken, at 86, merely increase the rate of convection of the cooling system fluids. If the coolant-overheating condition persist after such measures are taken, and after the convection can be increased no further, then the EGR program is altered, at 90, to provide more effective cooling. If the coolant-overheating condition persist after these measures are taken, and after the relative amount of external LP EGR can be increased no further, then the compressor torque is reduced, at 92. This action naturally reduces the amount of heat evolved by combustion, but it also provides another way to discharge heat from the coolant, as noted hereinabove. Finally, if the coolant-overheating condition persist even after all of the above measures have been taken, additional and more radical modes of coolant protection may be applied—modes that involve operating one or more cylinders unfueled or reducing the heat-exchange efficiency of the EGR coolers.

It will be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in an electronic control system.

It will be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Finally, it will be understood that the systems, and methods described herein are exemplary in nature, and that these specific embodiments or examples are not to be considered in a limiting sense, because numerous variations are contemplated. Accordingly, this disclosure includes all novel and non-obvious combinations and sub-combinations of the various, systems, and methods disclosed herein, as well as any and all equivalents thereof.

The invention claimed is:

1. A method for operating an engine system having a cylinder, an exhaust turbine and an intake-air compressor, the method comprising:

charging the cylinder with exhaust from upstream of the exhaust turbine at a first rate;

charging the cylinder with exhaust from downstream of the exhaust turbine at a second rate via an external low-pressure (LP) exhaust-gas recirculation (EGR) path;

increasing the second rate relative to the first rate in response to a coolant-overheating condition; and directing at least a portion of the exhaust through a waste gate, by-passing the exhaust turbine, combining the portion of the exhaust with exhaust flow from the exhaust turbine, in response to the coolant-overheating condition, the waste gate coupled across the exhaust turbine from an inlet to an outlet of the exhaust turbine.

2. The method of claim 1, wherein charging the cylinder with exhaust from upstream of the exhaust turbine comprises delivering the exhaust downstream of the intake-air compressor via an external high-pressure (HP) EGR path.

3. The method of claim 1, wherein charging the cylinder with exhaust from upstream of the exhaust turbine comprises controlling a valve timing of the cylinder to retain exhaust from a previous combustion event in the same cylinder during a subsequent combustion event.

4. The method of claim 1 further comprising detecting the coolant-overheating condition.

5. The method of claim 4, wherein detecting the coolant-overheating condition comprises interrogating a sensor responsive to a temperature of the coolant.

6. The method of claim 4, wherein detecting the coolant-overheating condition comprises interrogating a sensor responsive to a pressure of the coolant.

7. The method of claim 4, wherein detecting the coolant-overheating condition comprises interrogating a sensor responsive to a dimension of an expandable cavity that contains the coolant.

8. The method of claim 4, wherein detecting the coolant-overheating condition comprises modeling heat balance in one or more components of the engine system as a function of an operating condition of the engine system.

9. The method of claim 1 further comprising reducing torque applied to the compressor in response to the coolant-overheating condition.

10. The method of claim 9, wherein the engine system includes a charge-air cooler coupled downstream of the compressor, the method further comprising maintaining or increasing a coolant flow to the charge-air cooler when the torque is reduced in response to the coolant-overheating condition.

11. The method of claim 1 further comprising disabling a fuel injector of the cylinder and drawing air through the cylinder in response to the coolant-overheating condition.

12. The method of claim 1 further comprising:

passing a portion of the exhaust from upstream of the compressor or the exhaust from downstream of the compressor through a first conduit of a heat exchanger;

flowing coolant through a second conduit of the heat exchanger; and reducing the portion in response to the coolant-overheating condition.

13. The method of claim 1 further comprising:

passing a portion of the exhaust from upstream of the compressor or the exhaust from downstream of the compressor through a first conduit of a heat exchanger;

flowing coolant through a second conduit of the heat exchanger; and increasing a rate of flow of the coolant through the second conduit in response to the coolant-overheating condition.

14. The method of claim 1 further comprising:

flowing coolant through a radiator cooled by ambient air; and increasing convention of the ambient air in response to the coolant-overheating condition.

15. A method for operating an engine system having a charge-air cooler coupled downstream of an intake-air compressor, comprising:

in response to a coolant-overheating condition:

increasing a rate of heat flow from the engine system to ambient air; reducing torque applied to the intake-air compressor only if the coolant-overheating condition persists after said rate of heat flow is increased; and maintaining or increasing a coolant flow to the charge-air cooler when the torque is reduced.

16. The method of claim 15, wherein the engine system includes an exhaust turbine mechanically coupled to the intake-air compressor, and wherein reducing the torque applied to the compressor comprises by-passing exhaust flow around an exhaust turbine in response to the coolant-overheating condition.

17. The method of claim 15, further comprising detecting the coolant-overheating condition.

18. The method of claim 15, wherein increasing said rate of heat flow comprises increasing a rate of external low-pressure (LP) exhaust-gas recirculation (EGR) relative to a rate of external high-pressure (HP) or internal EGR.

19. A method for operating an engine system having a cylinder, an exhaust turbine and an intake-air compressor, the method comprising:

charging the cylinder with exhaust from upstream of the turbine at a first rate;

charging the cylinder with exhaust from downstream of the turbine at a second rate via an external low-pressure (LP) exhaust-gas recirculation (EGR) path;

detecting a coolant-overheating condition;

increasing the second rate relative to the first rate in response to the coolant-overheating condition;

reducing torque applied to the intake-air compressor if the coolant-overheating condition persists after the second rate is increased relative to the first rate; and maintaining or increasing a coolant flow to a charge-air cooler when the torque is reduced in response to the coolant-overheating condition.

* * * * *